United States Patent [19]

Hildebrand

[11] 4,423,765

[45] Jan. 3, 1984

[54] APPARATUS FOR REDUCING HEATER AND AIR CONDITIONING ENERGY CONSUMPTION

[75] Inventor: Paul N. Hildebrand, Oklahoma City, Okla.

[73] Assignee: Orange Energy Systems, Inc., Lawton, Okla.

[21] Appl. No.: 384,017

[22] Filed: Jun. 1, 1982

[51] Int. Cl.[3] ..... F23N 5/20; H03K 3/17

[52] U.S. Cl. ..... 165/12; 236/46 R; 307/265; 361/196

[58] Field of Search ..... 165/12, 26; 236/46 R; 307/293, 141, 265, 267; 62/231; 361/196

[56] References Cited

U.S. PATENT DOCUMENTS

| | | | |
|---|---|---|---|
| 2,221,041 | 11/1940 | Baker . | |
| 2,266,563 | 12/1941 | McCorkle . | |
| 2,348,143 | 5/1944 | Miller . | |
| 2,615,634 | 10/1952 | Harbin, Jr. . | |
| 2,672,291 | 3/1954 | Rifle . | |
| 2,862,666 | 12/1958 | Kriechbaum . | |
| 3,486,693 | 12/1969 | Stang, Jr. et al. . | |
| 3,921,899 | 11/1975 | Hamilson . | |
| 4,027,171 | 5/1977 | Browder et al. | 236/46 R X |
| 4,090,664 | 5/1978 | Elderkin . | |
| 4,105,978 | 8/1978 | Goss et al. | 307/267 X |
| 4,140,274 | 2/1979 | Nabinger . | |
| 4,333,519 | 6/1982 | Shafrir et al. | 165/12 |

*Primary Examiner*—William E. Wayner

*Attorney, Agent, or Firm*—Laney, Dougherty, Hessin & Beavers

[57] ABSTRACT

The apparatus includes a first triac having terminals to which the control wire of a heater gas inlet valve solenoid or other heating element is connected and the apparatus further includes a second triac to which the control wire of an air conditioner compressor or other cooling element is connected. The triacs are actuated by respective optical coupling devices. One or the other of the optical coupling devices is selected by a switch to indicate whether the heater or air conditioner mode is selected. Whichever optical coupling device, and thus whichever mode, is selected, a timer circuit provides a selectable timing signal to cause the selected optical coupling device to periodically actuate or deactuate the associated triac to thereby activate or deactivate the solenoid or compressor (or other element) associated with the triac.

4 Claims, 2 Drawing Figures

APPARATUS FOR REDUCING HEATER AND AIR CONDITIONING ENERGY CONSUMPTION

BACKGROUND OF THE INVENTION

This invention relates generally to apparatus for reducing heating and air conditioning energy consumption and more particularly, but not by way of limitation, to apparatus for controlling, at a preselected time period, the heater solenoid and air conditioner compressor of a heating and air conditioning system.

In a temperature-control unit such as a conventional heating and air conditioning system of the type found in a home, the heater or furnace portion includes a burner having a gas inlet valve which is actuated in response to a master thermostat located in the home. When the temperature detected by the thermostat is below a selected setting, the thermostat signals the valve to open, thereby allowing gas to flow into the burner for being ignited by a pilot flame. This gas inlet flow and gas ignition continues throughout the period during which the thermostat is signaling the system to provide heat to the home. During part of this period, a fan which is also a part of the heating and air conditioning system turns on when a predetermined temperature is reached in the plenum chamber of the furnace.

By means of this operation, there is a continuous flow of fuel (i.e., gas in this example) during the entire period that the thermostat is signaling the furnace to provide heat. Such a continuous flow of fuel is wasteful because it is not necessary to continuously supply fuel and heat the air in the plenum chamber to achieve sufficient heating. By appropriately cycling the flow of fuel and application of heat, substantially the same amount of heat transferred to and from the air in the plenum chamber can be achieved as would be achieved by continuously flowing the fuel and applying heat, and in addition, fuel can be conserved by such cycling. Also by appropriately cycling the flow of fuel and application of heat, the furnace is operated so that destratification of the air occurs whereby the space served by the furnace is more evenly heated.

The air conditioner compressor of the air conditioning portion of the conventional heating and air conditioning system functions similarly to the heater or furnace portion in that the air conditioner compressor is operated for a longer period of time than is necessary to achieve an adequate amount of cooling. By appropriately cycling the operation of the compressor, substantially the same amount of cooling can be achieved and the energy used to operate the compressor can be conserved. Destratification of the air can likewise be achieved.

Therefore, there is the need for an apparatus which can control the operation of the energy-consuming members (i.e., the burner or other heater element, such an electric heat strips, in a furnace or the compressor or other cooling element in an air conditioner) in a temperature-control unit, such as a conventional home heating and air conditioning system. Although I am aware of prior apparatus which attempt to conserve fuel in heating and air conditioning systems by cycling the energy-consuming members in response to sensed temperatures, I am unaware of any fuel-conservation apparatus which controls the energy-consuming members at a selectable predetermined time period having a duration which is not dependent on the ambient temperatures within the systems. Therefore, there is the need for an apparatus which controls energy-consuming members of a heating and air conditioning system at selected predetermined time periods to achieve efficient fuel utilization and destratification without regard to specific ambient temperatures within the system (other than the temperature detected by the master thermostat which controls the overall system). This need also arises because utility companies often charge for energy consumption on a time basis, such as by the demand charge method wherein the peak power usage during each fifteen minute period is used.

SUMMARY OF THE INVENTION

The present invention overcomes the above-noted and other shortcomings of the prior art by providing a novel and improved apparatus for reducing heating and air conditioning energy consumption. This apparatus controls the energy-consuming members of the system at selectable predetermined time periods without regard to ambient temperatures (other than the temperature detected by the master thermostat). Through the operation of this apparatus fuel is conserved and yet substantially the same amount of heating or cooling is provided by means of the "inertial" heating or cooling provided by the respective heater or air conditioner elements (e.g., a compressor builds up a high pressure on its coolant, such as freon, which provides "inertial" cooling after the compressor is deactivated).

Broadly, the present invention provides an apparatus for controlling the operation of a temperature-control unit having an energy-consuming member which is responsive to a control signal. The apparatus comprises control signal communication means for providing a switchable communication path along which the control signal travels to the energy-consuming member. The apparatus further comprises timer means for periodically opening the communication path so that the control signal is prevented from traveling to the energy-consuming member, thereby preventing the energy-consuming member from consuming energy during such open periods.

With reference particularly to a heating and air conditioning system comprising a heater solenoid which has a solenoid control wire electrically connected between the heater solenoid and a heater solenoid control signal generator means and further comprising an air conditioner compressor which has a compressor control wire electrically connected between the air conditioner compressor and an air conditioner compressor control signal generator means, the control signal communication means includes first switch means connected in electrical series with the solenoid control wire between the heater solenoid and the heater solenoid control signal generator means and also includes second switch means connected in electrical series with the compressor control wire between the air conditioner compressor and the air conditioner compressor control signal generator means. The timer means provides part of a switch control means for controlling the opening and closing of the first and second switch means. Another part of the switch control means is a switch select means for selecting which of the first and second switch means is to be periodically opened or closed by the timer means. The timer means includes period select means for controlling the duration of the periodic opening and closing of the first or second switch means.

From the foregoing it is a general object of the present invention to provide a novel and improved apparatus for reducing heating and air conditioning energy consumption. Other and further objects, features and advantages of the present invention will be readily apparent to those skilled in the art when the following description of the preferred embodiment is read in conjunction with the accompanying drawings.

DETAILED DESCRIPTION OF THE INVENTION

Figure 1:
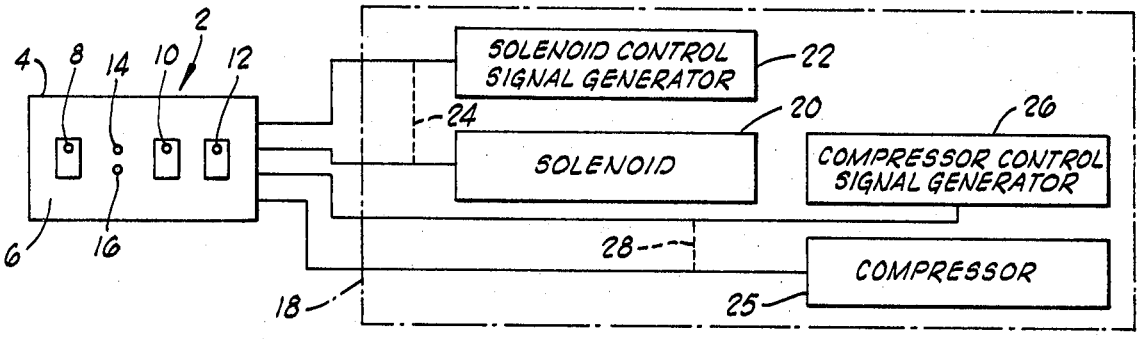
FIG. 1 is a block diagram showing an apparatus constructed in accordance with the present invention connected to a heating and air conditioning system.

With reference to the drawings, the preferred embodiment of an apparatus 2 constructed in accordance with the present invention will be described. FIG. 1 discloses that the apparatus 2 includes a housing 4 having a side 6 with which are associated an on/off switch arm 8, a function select switch arm 10 and a time period, or rate select switch arm 12. Also associated with the side 6 are a first indicator means 14, such as a red light-emitting diode, and a second indicator means 16, such as a green light-emitting diode, for indicating which function (i.e., either heating or cooling) is selected in response to actuation of the function select switch arm 10.

FIG. 1 also illustrates that the apparatus 2 is connected to a heating and air conditioning system 18 of a conventional type as is found in a home. The system 18 includes a heater or furnace comprising a heater solenoid 20 which is actuated to control a gas inlet valve (not shown) as known to the art. As also known to the art, the solenoid 20 is controlled by a solenoid control signal generator means 22 which provides a solenoid control signal over a solenoid control wire 24 ordinarily electrically connected between the solenoid 20 and the solenoid control signal generator means 22. The solenoid control wire 24 is shown as a dashed line in FIG. 1 to indicate that this ordinary direct electrical connection is not made when the apparatus 2 is utilized with the system 18. When the apparatus 2 is used with the system 18, the apparatus 2 is connected in electrical series with the wire 24. Such serial connection is made, for example, by cutting the wire 24 and electrically connecting the cut ends to respective portions of the apparatus 2 as will be more particularly described hereinbelow. It is to be noted that other suitable heating elements, such as electric heat strips, can be used with the present invention; however, for simplicity of description, the following description will refer only to the gas heating element including the solenoid 20.

The system 18 also includes an air conditioning unit including a compressor 25 (or other suitable cooling element) which is ordinarily activated by a compressor control signal generator means 26 as known to the art. This ordinary control is made by a suitable control signal communicated to the compressor 25 by means of a compressor control wire 28 electrically connected between the air conditioner compressor 25 and the air conditioner compressor control signal generator means 26. However, as with the wire 24, when the apparatus 2 is utilized with the system 18, the wire 28 does not directly electrically communicate the compressor 25 with the compressor control signal generator means 26 (as indicated by the dashed line); rather, the wire 28 is connected in electrical series with the apparatus 2. As with the wire 24, this can be accomplished by cutting the wire 28 and connecting the cut ends to respective portions of the apparatus 2 as will be more particularly described hereinbelow.

Figure 2:
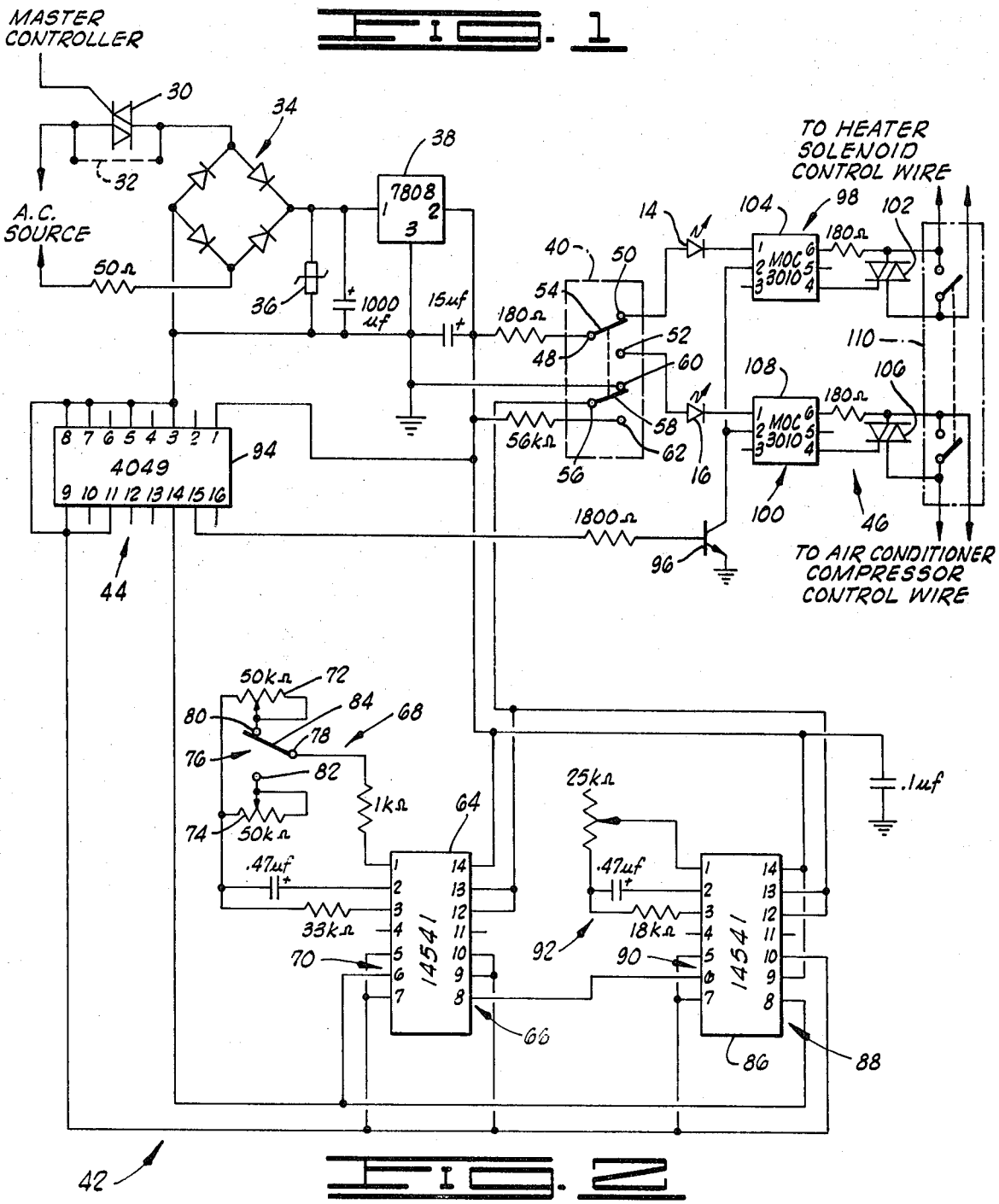
FIG. 2 is a schematic circuit diagram of the preferred embodiment of the present invention.

The preferred embodiment of the apparatus 2 includes an electronic circuit schematically illustrated in FIG. 2. This preferred circuit is designed to be energized by a suitable alternating current source, such as the source available at an ordinary home electrical outlet. This source is contemplated to be switchably connected to the circuit by means of a triac 30 or other suitable controllable switch means. It is further contemplated that a master controller means, such as one for controlling a plurality of apparatus 2 or for overriding the normal operation of a single apparatus 2, can be connected to the gate terminal of the triac 30. When a single apparatus 2 is used without a master controller, a jumper wire 32 is connected in electrical parallel to the triac 30 so that the alternating current source is directly applied to a full-wave rectifier means 34. To protect the circuit of the apparatus 2 from surges at the unregulated output of the rectifier means 34, the circuit includes a suitable surge suppression means 36 as known to the art. The unregulated output of the rectifier means 34 is provided to a voltage regulator means 38.

The voltage regulator means 38 of the preferred embodiment provides a regulated +8 V output. This regulated positive voltage provides a first logic level utilized within the circuit of the apparatus 2. A ground is also provided within this circuit so that a second logic level is established thereby for utilization within the circuit. Broadly, the above-described power portion of the circuit can be said to include first logic level means for providing a first logic level and a second logic level means for providing a second logic level.

The preferred embodiment circuit of the apparatus 2 further includes communication switch control means and control signal communication means. The communication switch control means includes function switch select means 40, timer means 42, and connector means 44 for connecting the timer means 42 to the control signal communication means which is generally identified in FIG. 2 by the reference numeral 46.

The function switch select means 40 includes, in the preferred embodiment, a double-pole, double-throw gang switch. This switch includes a first pole terminal 48 electrically connected to the first logic level means as shown in FIG. 2. This switch also includes a first throw terminal 50 and a second throw terminal 52 between which a first switch element 54 is switchable. The switch element 54 is suitably connected to the first pole terminal 48 in a manner as known to the art. The switch also includes a second pole terminal 56 to which is suitably connected a second switch element 58 for switchable movement between a third throw terminal 60 and a fourth throw terminal 62. The third throw terminal 60 is electrically connected to the second logic level means, and the fourth throw terminal 62 is electrically connected to the first logic level means. The second switch element 58 is mechanically connected to the first switch element 54 for simultaneous movement therewith.

The timer means 42 includes a first integrated circuit programmable timer 64 having two of its inputs connected to the second pole terminal 56 as shown in FIG. 2. The integrated circuit timer 64 has an output terminal 66 at which is provided an output signal having a selectable period which is defined by a variable resistor-capacitor circuit means 68. The integrated circuit timer 64 also has a master reset terminal 70.

The variable resistor-capacitor circuit means 68 is connected to suitable terminals of the integrated circuit timer 64 as known to the art. The variable resistor-capacitor circuit means 68 has a first variable resistor 72, such a potentiometer, and a second variable resistor 74, such as another potentiometer. The variable resistor-capacitor circuit means 68 also includes a mechanical single-pole, double-throw switch 76 having a pole terminal 78 which is electrically connected to the integrated circuit timer 64 and having two throw terminals 80, 82, each of which is connected to a respective one of the variable resistors 72 and 74. The switch 76 also includes a switch element 84 connected to the pole terminal 78 for switchably connecting the integrated circuit timer 64 to either the variable resistor 72 or the variable resistor 74.

The timer means 42 also includes a second integrated circuit programmable timer 86 having two inputs connected to the pole terminal 56. The integrated circuit timer 86 also includes an output terminal 88 which is electrically connected to the master reset terminal 70 of the integrated circuit timer 64, and the integrated circuit timer 86 includes a master reset terminal 90 which is electrically connected to the output terminal 66 of the integrated circuit timer 64. Associated with the integrated circuit timer 86 in a manner as known to the art is a variable resistor-capacitor circuit means 92 which forms another part of the timer means 42.

The connector means 44 includes an integrated circuit 94 which includes an inverter logic gate having an input electrically connected to the output terminal 88 of the integrated circuit timer 86. The inverter logic gate is used to protect the energy-consuming members by shutting them off during momentary power outages. The inverter logic gate also has an output which is electrically connected to the base of a transistor 96 forming another element of the connector means 44. The transistor 96 also includes a collector which is electrically connected to the control signal communication means 46.

The control signal communication means 46 provides a switchable communication path along which a control signal from the solenoid control signal generator 22 or the compressor control signal generator 26 travels to an energy-consuming member, such as the solenoid 20 or the compressor 25, respectively. The control signal communication means 46 is responsive to the communication switch control means so that the control signal communication means 46 periodically opens whereby the control signal is prevented from traveling to the energy-consuming member, thereby preventing the energy-consuming member from consuming energy. In the preferred embodiment of the control signal communication means 46 which is contemplated to be used with the heating and air conditioning system 18, there is included a first control signal communication switch means 98 and a second control signal communication switch means 100.

The switch means 98 is connected in electrical series with the solenoid control wire 24 between the solenoid 20 and the solenoid control signal generator means 22. This is accomplished in the preferred embodiment by cutting or otherwise suitably disconnecting the wire 24 and connecting one of the ends to one of the terminals of a triac 102 and connecting the other end to the other terminal of the triac 102. The triac 102 also includes a gate terminal which is electrically connected to a control output of a first optical coupling means 104. The optical coupling means 104 has a first input electrically connected to the first throw terminal 50, and the optical coupling means 104 has a second input electrically connected to the collector of the transistor 96. These connections make the coupling means 104 responsive to the communication switch control means.

The switch means 100 is connected in electrical series with the compressor control wire 28 between the air conditioner compressor 25 and the compressor control signal generator means 26. This is accomplished by cutting or otherwise suitably disconnecting the wire 28 and connecting a first one of the ends to a first terminal of a triac 106 and connecting a second one of the ends to a second terminal of the triac 106. The triac 106 also includes a gate terminal which is connected to a control output of another optical coupling means 108. The optical coupling means 108 has a first input electrically connected to the second throw terminal 52 and has a second input electrically connected to the collector of the transistor 96 so that the optical coupling means 108 is also responsive to the communication switch control means.

Connected in electrical parallel with the triacs 102 and 106 is a mechanical double-pole, single-throw gang switch 110 as shown in FIG. 2. The switch 110 includes switch elements which are ganged or mechanically connected so that they move simultaneously with each other.

The electrical connections between the first throw terminal 50 and an input of the optical coupling means 104 and between the second throw terminal 52 and an input of the optical coupling means 108 are made by means of the indicator means 14 and 16, respectively, as shown in FIG. 2. In the preferred embodiment the indicator means 14 is a red light-emitting diode which, when illuminated, indicates that the heating function has been selected whereby any control signal generated by the solenoid control signal generator means 22 in response to a master thermostat (not shown) is periodically or cyclically communicated and not communicated to the solenoid 20; and the indicator means 16 of the preferred embodiment is a green light-emitting diode which, when illuminated, indicates that the cooling function has been selected whereby the control signal generated by the compressor control signal generator means 26 in response to the master thermostat is periodically or cyclically communicated and not communicated to the compressor 25.

It is to be noted that the foregoing circuit elements are of suitable types known to the art, such as those elements specifically identified in FIG. 2.

To utilize the apparatus 2, the control wire 24 is disconnected from its ordinary coupling of elements 20 and 22 and connected as described hereinabove to respective terminals of the triac 102, and the control wire 28 is disconnected from its ordinary coupling of elements 25 and 26 and connected to respective terminals of the triac 106. If the apparatus 2 is to be used to control the housing and air conditioning system 18 once the wires 24 and 28 have been connected to the apparatus 2, the switch 110 is placed in its open position as illustrated in FIG. 2. This open position is achieved by appropriately manipulating the switch arm 8 which is associated with the switch 110. If the switch 110 is closed by appropriate movement of the switch arm 8, the triacs 102 and 106 are short-circuited whereby the heating and air conditioning system 18 functions in its ordinary manner.

With the switch 110 open, the apparatus 2 controls the heating and air conditioning system 18 so that either the solenoid 20 or the compressor 25 is periodically controlled in response to the control signal from the respective control signal generator means and in accordance with the setting of the timer means 42 to prevent either the solenoid 20 or the compressor 25 from continuously running during the entire period when the master thermostat (not shown, but a part of the solenoid control signal generator 22 and the compressor control signal generator 26) of the heating and air conditioning system 18 is indicating that heat or air conditioning is to be provided. This control is effected through the periodic opening and closing of the communication path provided through the triacs 102 and 106 between the solenoid control signal generator means 22 and solenoid 20 and between the compressor control signal generator means 26 and the compressor 25, respectively. The period of this opening and closing can be varied by manipulation of the timer means 42.

Once the switch 110 has been opened so that the apparatus 2 can control the heating and air conditioning system 18, the function select switch arm 10 which is associated with the function switch select means 40 is manipulated to select whether the heating or air conditioning function of the heating and air conditioning system 18 is to be cyclically controlled. By moving the switch elements 54 and 58 to their positions shown in FIG. 2, the heating mode is selected. In this mode, the indicating means 14 is illuminated. If the switch elements 54 and 58 are moved to their other positions adjacent terminals 52 and 62, respectively, the cooling function is selected and the indicating means 16 is illuminated. Therefore, the select means 40 provides a means for selecting which of the switch means 92 or 100 is to be periodically opened or closed in response to the timer means 42 and thereby which of the functions of the system 18 is to be controlled.

When the functional mode of the heating and air conditioning system 18 has been selected by manipulation of the switch arm 10, the appropriate time period for opening and closing the selected one of the switch means 98 and 100 is chosen by appropriately manipulating the time period or rate selector arm 12 which is associated with the switch 76 of the timer means 42. This is a period select means for controlling the duration of the periodic opening and closing of the switch means 98 and 100.

When the appropriate time period has been selected (which period can be varied not only by the actuation of the switch 76, but also by the setting of the variable resistors 72 and 74), the integrated circuit timer 64 provides a time output signal through the output 66. the integrated circuit timer 86 responds to the timed output signal from the output terminal 66 by providing its own output signal through its output terminal 88. The output signal from the terminal 88 resets the integrated circuit timer 64. The output signal from the terminal 88 is also provided to the connector means 44 so that the switch means 98 and 100 are responsive thereto. The period of the control signal provided by the timer means 42 is selectable between two variable, but predetermined, resistances established by the settings of variable resistors 72 and 74.

When one of the optical coupling means 104 or 108 is selected by means of the function switch select means 40, that optical coupling means responds, via the inverter of element 94 and the transistor 96, to the signal from the integrated circuit timer 86 to actuate the respective triac associated therewith, thereby closing the communication path between the control signal generator means and the respective energy-consuming member when the triac is made conductive by the control signal and opening the communication path therebetween when the triac is made non-conductive by the control signal.

From the description of the operation it is apparent that the apparatus 2 is not dependent upon or responsive to any ambient temperature other than the temperature detected by the master thermostat and as to the temperature detected by the master thermostat, it is only pertinent to whether either of the control signal generators 22, 26 is providing a control signal and not to whether the communication path is being opened or closed.

As described hereinabove the apparatus 2 may be used with a conventional temperature-control unit which also includes a fan that operates during at least a portion of the duty cycle during which the main thermostat signals for heating or cooling to be provided. It has been found that with the apparatus 2 in use, this duty cycle is longer and the fan operates longer, thereby aiding in destratifying the areas serviced by the temperature-control unit. Although the duty cycle is longer, it has also been found that periods between the duty cycles are longer and that energy is saved both in the operation of the heating and cooling elements (e.g., gas burner and compressor) and in the operation of the fan.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for controlling the operation of a heater element which has a heater element control wire electrically connected between said heater element and a heater control signal generator means and the operation of an air conditioner cooling element which has a cooling element control wire electrically connected between said air conditioner cooling element and an air conditioner control signal generator means, said apparatus comprising:

first switch means connected in electrical series with said heater element control wire between said heater element and said heater control signal generator means;

second switch means connected in electrical series with said cooling element control wire between said air conditioner cooling element and said air conditioner control signal generator means;

switch control means for controlling the opening and closing of said first and second switch means, said switch control means including the timer means for periodically opening and closing said first or second switch means, said timer means including:

first integrated circuit timer means for providing a first output signal having a selectable period, said first integrated circuit timer means having a master reset input; and second integrated circuit timer means, responsive to said first output signal, for providing a second output signal having a selectable period, said second output signal being communciated to said master reset input; and wherein said first and second switch means are responsive to said second output signal.

2. An apparatus for controlling the operation of a heater element which has a heater element control wire electrically connected between said heater element and a heater control signal generator means and the operation of the air conditioner cooling element which has a cooling element control wire electrically connected between said air conditioner cooling element and an air conditioner control signal generator means, said apparatus comprising:

first switch means connected in electrical series with said heater element control wire between said heater element and said heater control signal generator means, said first switch means including:

a first triac having two terminals connected in electrical series with said heater element control wire and also having a gate terminal; and a first optical coupling means, connected to said gate terminal of said first triac, for actuating said first triac;

second switch means connected in electrical series with said cooling element control wire between said air conditioner cooling element and said air conditioner control signal generator means, said second switch means including:

a second triac having two terminals connected in electrical series with said cooling element control wire and also having a gate terminal; and a second optical coupling means, connected to said gate terminal of said second triac, for actuating said second triac;

switch control means for controlling said first and second optical coupling means, said switch control means including:

timer means for periodically opening and closing said first or second switch means, said timer means including:

first integrated circuit timer means for providing a first output signal having a selectable period, said first integrated circuit timer means having a master reset input; and second integrated circuit timer means, responsive to said first output signal, for providing a second output signal having a selectable period, said second output signal being communciated to said master reset input; and means for connecting said second output signal to said first and second optical coupling means.

3. An apparatus for controlling the operation of a heater solenoid which has a solenoid control wire electrically connected between said heater solenoid and a heater solenoid control signal generator means and the operation of an air conditioner compressor which has a compressor control wire electrically connected between said air conditioner compressor and an air conditioner compressor control signal generator means, said apparatus comprising:

first logic level means for providing a first logic level;

second logic level means for providing a second logic level;

first switch means, including:

a first pole terminal electrically connected to said first logic level means;

a first throw terminal;

a second throw terminal;

a first switch element connected to said first pole terminal and switchable between said first and second throw terminals;

a second pole terminal;

a third throw terminal electrically connected to said second logic level means;

a fourth throw terminal electrically connected to said first logic level means; and a second switch element connected to said second pole terminal and switchable between said third and fourth throw terminals;

timer means, including:

a first integrated circuit timer, electrically connected to said second pole terminal, having a first timer output and a first reset input;

first variable resistor-capacitor circuit means, connected to said first integrated circuit timer, having a first variable resistor, a second variable resistor, and second switch means for switchably connecting said first integrated circuit timer to either said first variable resistor or said second variable resistor;

a second integrated circuit timer, electrically connected to said second pole terminal, having a second timer output electrically connected to said first reset input and further having a second reset input electrically connected to said first timer output; and second variable resistor-capacitor circuit means connected to said second integrated circuit timer;

first optical coupling means, including:

a first input electrically connected to said first throw terminal;

a second input; and a control output;

second optical coupling means, including:

a first input electrically connected to said second throw terminal;

a second input; and a control output;

connector means for electrically connecting said second input of said first optical coupling means and said second input of said second optical coupling means to said second timer output;

a first triac having a gate terminal electrically connected to said control output of said first optical coupling means and further having additional terminals connectable in electrical series with said solenoid control wire; and a second triac having a gate terminal electrically connected to said control output of said second optical coupling means and further having additional terminals connectable in electrical series with said compressor control wire.

4. An apparatus as defined in claim 3, wherein said connector means includes:

an inverter logic gate means having an input electrically connected to said second timer output and further having an output; and a transistor having a base electrically connected to said output of said inverter logic gate means and further having a collector electrically connected to said second inputs of said first and second optical coupling means.

* * * * *